United States Patent [19]

Lawson

[11] Patent Number: 5,022,887

[45] Date of Patent: Jun. 11, 1991

[54] HARD CUP BRASSIERE

[75] Inventor: LaJean Lawson, Corvallis, Oreg.

[73] Assignee: Playtex Apparel, Inc., Stamford, Conn.

[21] Appl. No.: 416,692

[22] Filed: Oct. 3, 1989

[51] Int. Cl.[5] ..... A41C 3/00; A41C 3/10; A41C 3/14

[52] U.S. Cl. ..... 450/54; 450/1; 450/32; 450/57; 2/267

[58] Field of Search ..... 450/32, 33, 37, 39, 450/40, 53, 54, 55, 56, 57, 58, 1; 2/73, 267

[56] References Cited

U.S. PATENT DOCUMENTS

| | | | |
|---|---|---|---|
| 1,018,066 | 2/1912 | Mayer et al. | 2/109 |
| 1,082,085 | 12/1913 | Kertel | 450/54 |
| 2,359,804 | 10/1944 | Struthers | 450/32 |
| 2,567,732 | 9/1951 | Rosenthal | 450/54 |
| 2,671,218 | 3/1954 | Luhr | 450/32 X |
| 2,864,373 | 12/1958 | Buckley | 450/57 |
| 2,884,928 | 5/1959 | Baer | 450/55 X |
| 4,023,575 | 5/1977 | Nixon | 450/57 |
| 4,261,366 | 4/1981 | Lamborn | 450/54 |
| 4,412,542 | 11/1983 | Reichert | 450/54 |
| 4,566,458 | 1/1986 | Weinberg | 450/54 |
| 4,607,640 | 8/1986 | McCusker | 450/1 |
| 4,637,398 | 1/1987 | Sherwood | 450/54 |
| 4,854,915 | 8/1989 | Luedy | 450/54 X |

FOREIGN PATENT DOCUMENTS

| | | | |
|---|---|---|---|
| 516415 | 9/1955 | Canada | 450/39 |

*Primary Examiner*—Werner H. Schroeder
*Assistant Examiner*—Jeanette E. Chapman
*Attorney, Agent, or Firm*—Grimes & Battersby

[57] ABSTRACT

A protective hard cup brassiere having two hard plate cups which are not the same, which overlap in the area of the sternum and which are held outwardly from the thorax and breasts as shown and described.

26 Claims, 4 Drawing Sheets

HARD CUP BRASSIERE

FIELD OF THE INVENTION

This invention is directed to a protective and supportive brassiere particularly suited to athletic and industrial use. In body contact sports such as basketball, football, and soccer there is a need to protect women's breasts from injury which results from impact. The risk to the breast is both short-term and long term because sports related bruises and contusions, in some cases, have been known to develop into more serious medical conditions such as infections, cysts, and benign tumors. In addition, females are more likely to achieve peak athletic performance when physical and psychological discomfort related to actual or potential impacts to the breasts is reduced.

DESCRIPTION OF THE PRIOR ART

Chest protectors or thorax protectors designed for women for athletic activities are known in the art as shown in U.S. Pat. Nos. 4,566,458 (Weinberg) and 4,607,640 (McCusker). These patents disclose breast protectors which are designed for fitting into individual pockets located in a brassiere. Each uses a rigid cup and attempts to distribute an impact force around the perimeter of the cup by designing the cup to follow the contour of the curve of the thorax of the wearer. The object of these designs is to transmit an impact force to the breast around the breast and into the rib cage and sternum of the wearer.

In these prior art designs, where the protector contacts the thorax all the way around the breast at all times, the force of a blow is transmitted directly to the thorax. There is no provision for absorbing a portion of the impact by any means other than direct transmission of the impact to the chest along the shell of the rigid cup protector.

In these prior art devices, there is no separation between the breast and the protective inserts or hard cup plates. In each, the breast plate is separated from the breast only by the thickness of the material of the inner liner of the brassiere.

In prior art designs, such as Weinberg and McCusker, two separate pockets are formed to hold the hard cups. These separate pockets are separated by a stitching along the center of the brassiere on the front, such that the separate individual pockets do not connect with each other in any way. In applicant's invention, however, there is but one pocket, with communication back and forth between the two cups in the region of the sternum to allow for overlap of the extension of the hard cup plates 12 and 14.

In prior art designs, such as Weinberg and McCusker, there is no articulation between the two hard cups, nor is any of the protection inherent to articulating plates present in the designs.

SUMMARY OF THE INVENTION

In this invention the hard cup plates are held slightly away from the breasts by an inner fabric liner in the area of the sternum and across the front of the brassiere. This separation provides for improved ventilation and cooling in the region of the breasts, and provides a means for absorbing a portion of the impact in the brassiere structure.

This invention utilizes a pair of articulating hard cup plates which overlap each other in the region of the sternum. This overlap allows the hard cup plates to move sideways during impact, and provides for better protection of the sternum because of the wide area of contact by the inner most of the overlapping plates. The design of this invention is particularly suited for female soccer players who may want to "chest" the ball.

In this invention, an additional extension across the sternum by the innermost hard cup plate is provided. This additional extension assures that the plates will always overlap, and provides for a surface for the outermost plate to ride against.

Unlike the prior art, the edges of the hard cup plates do not follow the contour of the body. In this invention, the body contour is followed along the outside lateral regions of the breast, but is departed from as the breast plate extends towards the sternum of the wearer. Entire contour contact is neither required nor desirable in this invention because the separation from the body provides for an additional spring action and freedom of movement not present in the prior art.

In this invention there is a single pocket used which covers the entire front of the brassiere. This single pocket is formed such that the inside fabric is cut smaller than the outside fabric. This smaller inside cut, in combination with the hard cup plate protectors, force the plates out of contact with the sternum area. The outward forcing and spacing provides for impact absorption when the hard cup plates are forced inward towards the breast and sternum of the wearer.

In this invention, the articulating hard cup plates cooperate together and depend upon each other, working in concert to create an overlapping, springy cushion effect and absorb impact. This concept is entirely missing in the prior art known to the applicant which only guards against impact because the cup is hard. The articulating hard plates of the hard cup extensions in the region of the sternum is a radical departure from the hard cup inserts in the prior art known to applicant.

DESCRIPTION OF A PREFERRED EMBODIMENT OF THE INVENTION

Figure 1:
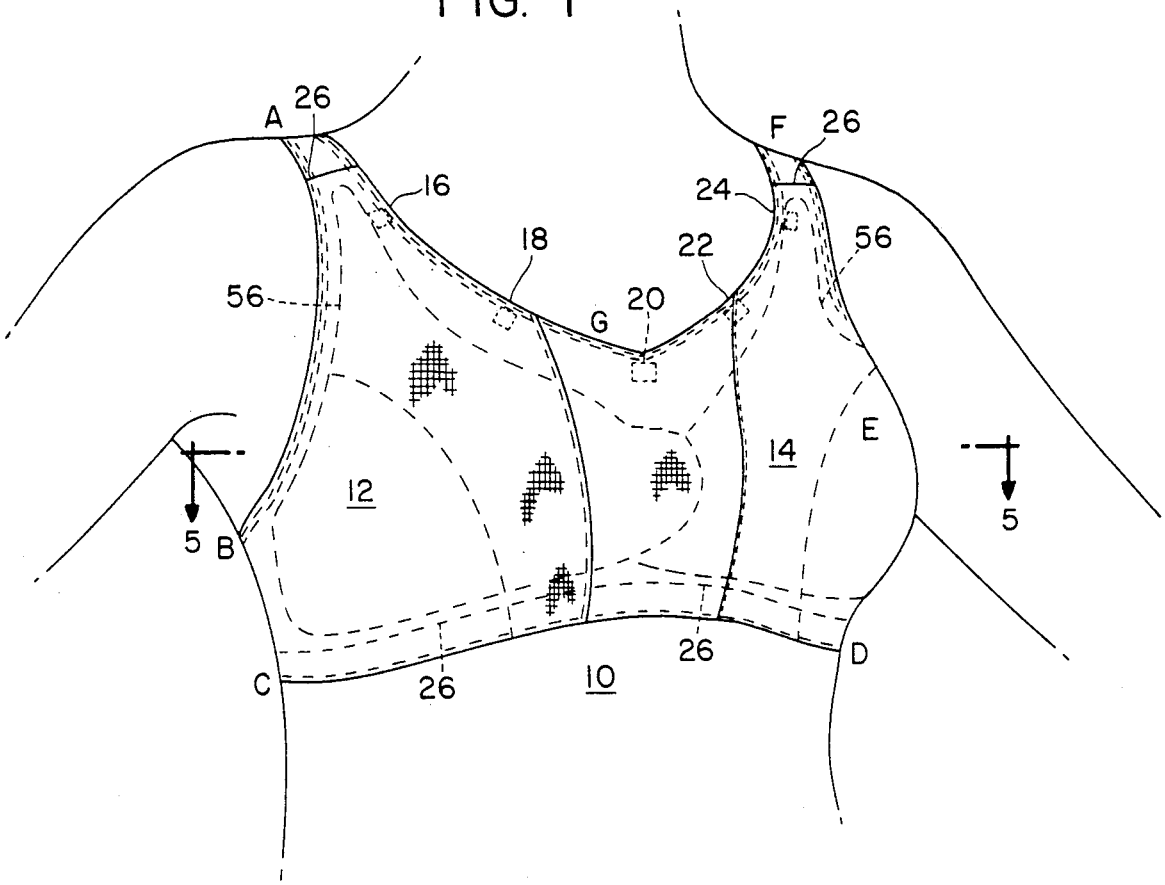
FIG. 1 is a front perspective view of the brassiere as worn by a person.

Referring to FIG. 1, where there is shown a view of the brassiere when worn by a person, the brassiere 10 is shown with the two hard cups 12 and 14, shown as phantom lines in this illustration, the hard cup breast plate 12 being shown overlapping the hard cup plate 14 in the region of the sternum.

Figure 4:
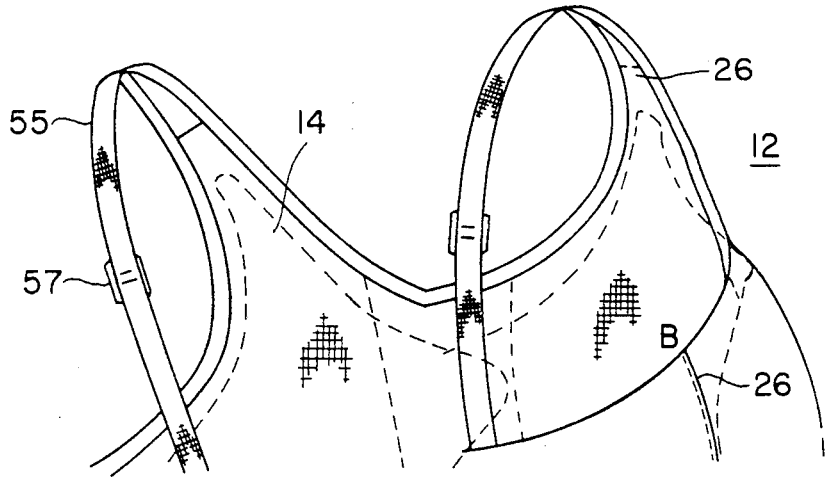
FIG. 4 shows a rear perspective view of the brassiere in accordance with this invention.

The stitching which defines the single pocket for holding both hard cup plates is defined by the stitch line 26, shown in FIGS. 1 and 4, extending from point A at the top of the wearer's right shoulder to point B under the right hand shoulder, to point C on the bottom line of the brassiere and under the right hand shoulder and hence to point D, up under the left hand shoulder to point E, to point F at the top of the left hand shoulder, to point G at the center of the neckline and then back to point A.

In FIGS. 1 and 4, the stitch line which defines the perimeter of the pocket is shown as reference numeral 26 as it passes from point A around the brassiere to point G and hence back to point A.

Across the top of the single pocket are fasteners 16, 18, 20, 22, and 24 which secure the top of the single pocket and which prevent excessive lateral movement of the hard cup breast plates 12 and 14. It should be noted that the distance from fastener 20 to the bottom front of the brassiere is substantially less than the distance from the top of each hard cup plate to the bottom. This allows limited movement of the articulating hard cup plates 12 and 14, but restricts their movement by snaps 16, 22, 18, and 24. The hard cups 12, 14 cannot slide completely across the front of the chest of the wearer of the brassiere.

Figure 2:
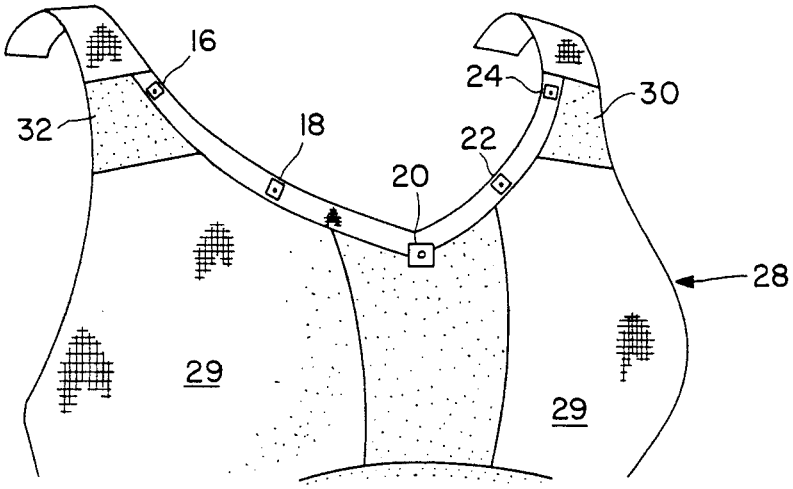
FIG. 2 is a front perspective view of the inner layer of the brassiere and the fasteners around the neckline.

The front inner layer 28, as shown in FIG. 2 includes the bottom half of the snap assembly 16, 18, 20, 22 and 24. The fabric over the region of the breast 29 is constructed of a CoolMax® spandex fabric, and is cut smaller than the dimensions of the outer layer. Padding is provided in the inner layer to assist in absorbing shock which is transmitted to the body through the hard cup plates 12 and 14. The padding 30–32 lies between 5B, hard cup plates 12 and 14 and the shoulder, and if the plates are deflected upwardly, padding 30–32 will protect the body from the upper edges of the plates 12 and 14.

Padding 34 is a ⅛" open cell foam or needle punched polyester backed with a CoolMax® fabric. This padding 34 across the sternum provides additional protection when a blow is received in the breast area which causes the plates 12 and 14 to deflect inward across the sternum region.

Additional ⅛" open cell foam padding or the like 36 is provided across the base of the brassiere to improve comfort and provide for protection when the hard cup plates 12 and 14 are deflected downwardly or inwardly along their bottom margin.

Figure 2A:
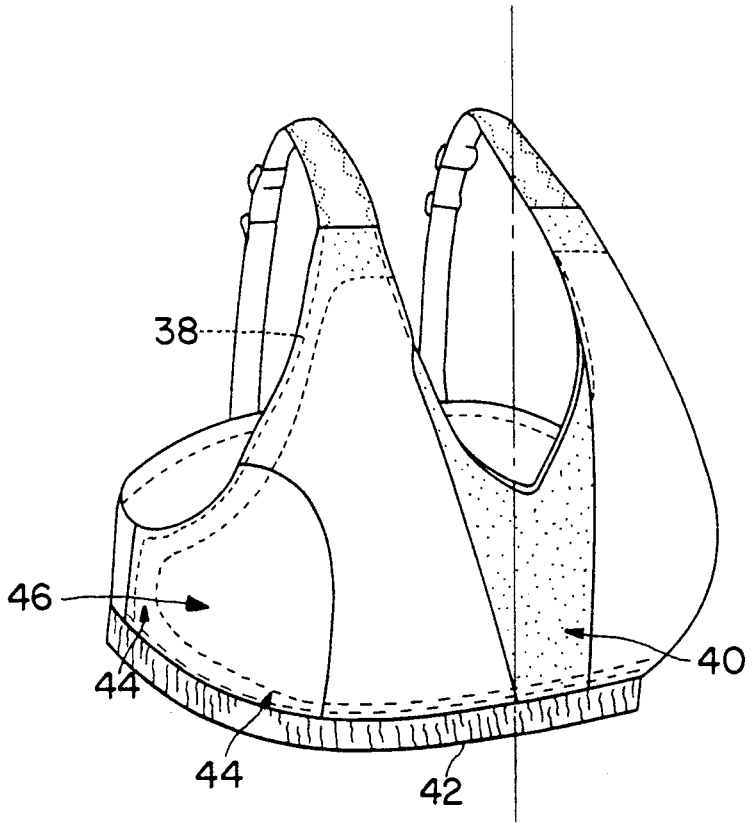
FIG. 2A is a front perspective view of the front outer layer of the brassiere.

FIG. 2A shows the front outer layer of the brassiere in accordance with this invention. The front includes a padded area 38 which is disposed along the sides and extends down under the armpits. Across the front sternum area is located a mesh insert 40 which provides ventilation in the region of the overlap of the hard cup plates 12 and 14. A fabric covered elastic band 42 is placed around the bottom to secure the garment to the user. Additional padding 44 is placed around the bottom of the brassiere. The cut of the fabric across the front of the outer layer is substantially larger than the corresponding fabric across the front inner portion which is depicted in FIG. 2. It is this difference in fabric length in the area that forms the front pocket which is defined by A–G as depicted in FIG. 1.

The outer layer of material on the front layer 46 as shown in FIG. 2A is a smooth high modulus warp knit.

Figure 3:
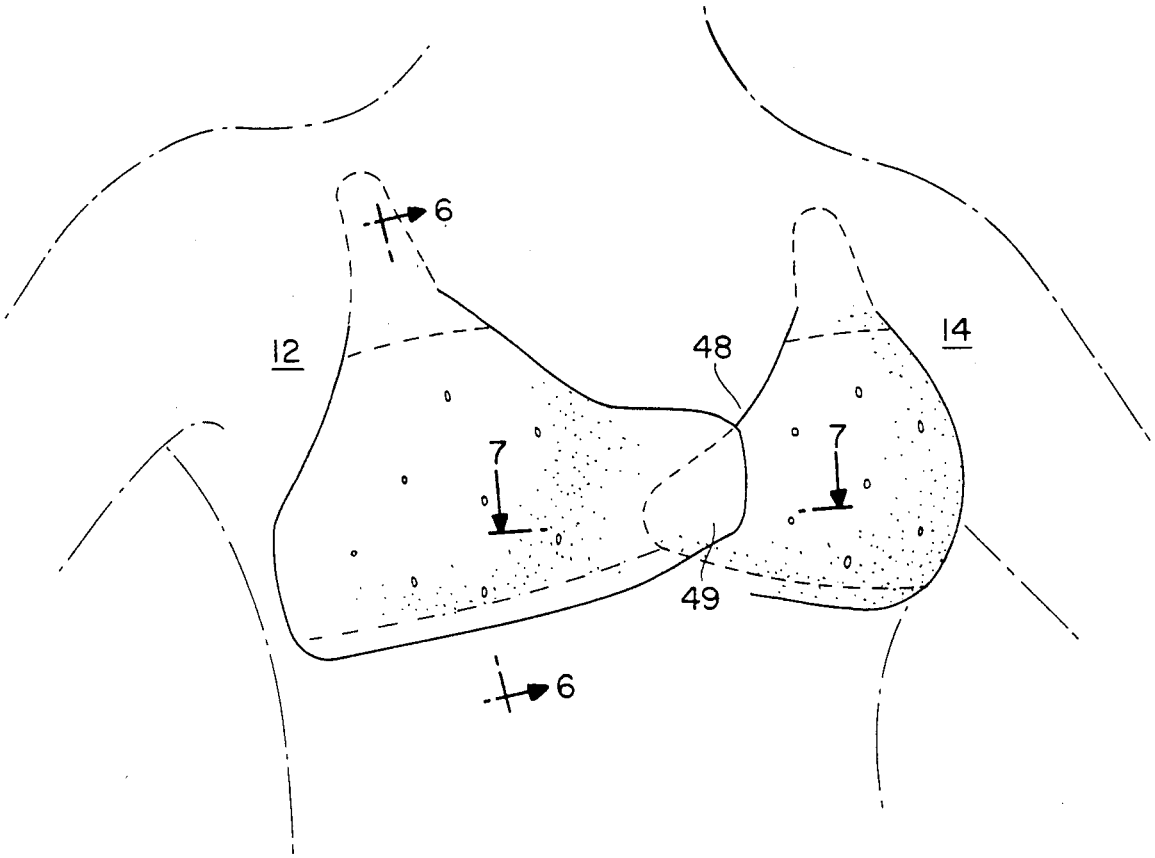
FIG. 3 is a front perspective view showing the general location of the right and left hard cup plates and their articulating overlap in the sternum.

In FIG. 3 there is shown the placement of the articulating hard cup plates 12 and 14. The plate 14 is shown as extending underneath plate 12, with tip 48 extending beyond the center line to a distance greater than that by which the corresponding tip 49 of upper plate 12 extends beyond the outer line. With this extension 48 of the breast plate 14, there is provided additional protection in the region of the wearer's sternum.

Figure 5:
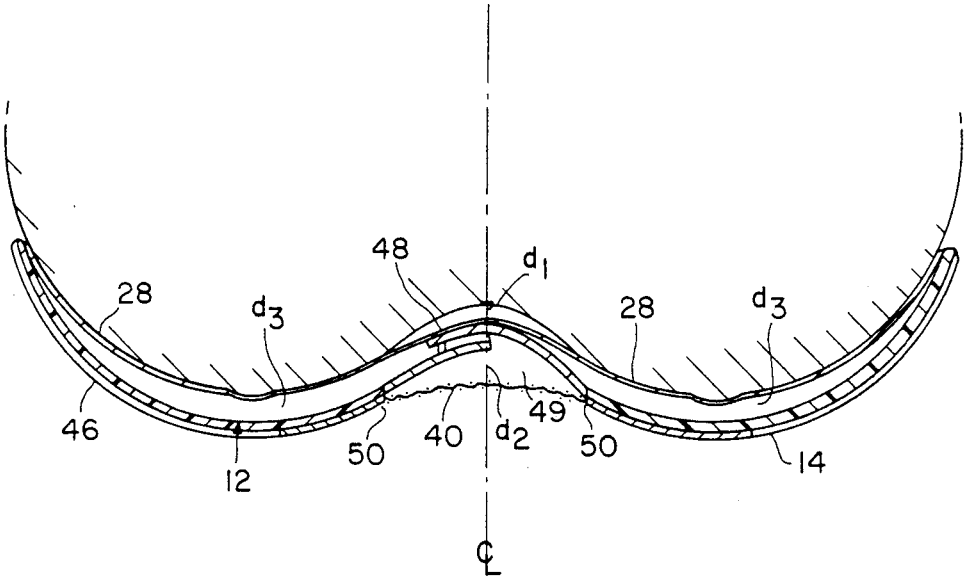
FIG. 5 shows a sectional view along lines 5—5 of FIG. 1 which illustrates the articulating overlap of the hard cup plates and the outward location of the hard cup plates with respect to the inner liner and the wearer's breasts.
Figure 7:
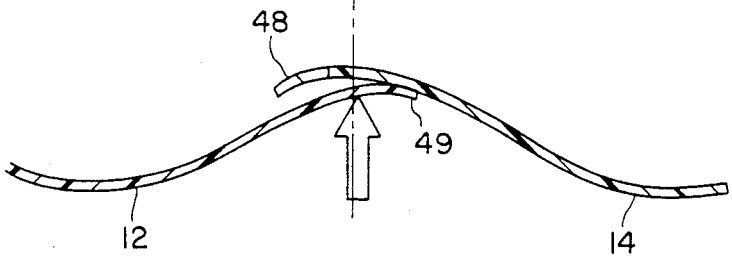
FIG. 7 shows a sectional view of two articulating hard cup plates of FIG. 3 along line 7—7.
Figure 8:
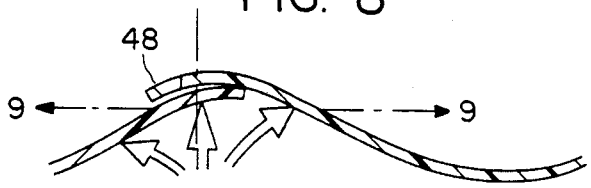
FIG. 8 shows the sectional view of the articulating hard cup plates of FIG. 7 and the lateral forces which are present when impact is received in the center of the sternum.

The additional extension 48 on cup 12 lies closest to the body. In most applications as is shown in FIGS. 5, 7 and 8, the extended cup will be the left cup because the majority of users are right-handed, and hence the right cup will be more "mobile". Since the right cup is the outer cup for the right-handed person, the right cup will be able to move laterally more easily enhancing the right arm mobility.

In this invention, the hard cups are preferably not merely mirror images of each other. In fact, they may be of different sizes and different shapes. The extended cup (lower cup) extends for an additional distance beyond the front center, the additional increment being approximately ½". This additional ½" provides additional protection to the sternum and provides a base for the outer cup to slide on it. The extension 48 on the inner cup lies beneath the edge 49 of the outer cup.

When the cups are inserted into the single brassiere pocket, the extended left cup is inserted first closer to the body, and then the right cup is inserted exterior to the left cup, in the case of a right-handed wearer. When the cups are in place, the fasteners 16, 18, 20, 22 and 24 retain them in place on each side of the single pocket defined by A through G as shown in FIG. 1.

FIG. 4 depicts the brassiere as seen from the back. The rear panels 50 and 52 are constructed of a high modulus synthetic elastomeric knit fabric. A hook closure 54 is used to secure the brassiere at the rear, and metal strap adjusters 56 are used to adjust the strap length. The seam line forms the underarm section of the pocket edge 26 along the line B to C. In the bottom as shown in FIG. 4, the extended hard cup plate across the sternum is the wearer's right breast plate 12.

In FIGS. 5, 7 and 8 there are shown cross-sectional views of a brassiere as used by a right-handed wearer (the extended cup 12 is on the wearer's left). Also, in FIGS. 5, and 8, the extension 48 on the hard cup breast plate 14 is shown beneath the edge 49 of plate 12, and extending further to the user's right than does hard cup breast plate 12 extend the user's left. The "S" shaped cross sections of each articulating hard plate 12 and 14 is shown in the cross sections of FIGS. 5, 7 and 8.

In FIG. 5 there is shown the result of the construction of the inner layer 28 which is cut smaller than the outer layers 46 and 40. The cut short inner layer 28, (because of the tension across the breast), maintains a small distance $d_1$ between the wearer's sternum and the inner layer 28 when in normal use. Another distance $d_2$ is maintained between the outer face of hard cup breast plate 14 at the breast center line. This distance again is determined in part by the difference of cut between the inner layer 28 and outer layer 46 and 40. The elastic section 40 also pulls the outer layer together, thus forming a triangle between the point of intersection of the hard cup 14 and the center line, and the locations 50 where the elastic material is attached to the front material 46.

In FIG. 7 there is shown a cross-section of the articulating hard cup plates 12 and 14 when a force is applied along the center line of the wearer. The extension 48 on hard cup breast plate 14 is again shown in FIG. 7. As the force along the center line is first received by the plates, it can be seen that when they are located as shown in FIG. 5 with respect to the body, the plates may move inward towards the wearer's sternum. As the plates move inward, they also are required to move laterally outward in order to provide the additional distance along the plates that is required.

FIG. 8 shows the effect of the movement along arrow 9—9 which causes some of the thrust initially applied along the center line to be decelerated and transferred laterally along 9—9 and away from the sternum of the wearer.

Referring again to FIG. 5, the difference in cut between the inner layer 28 and the outer layer 46 is seen to produce a space which is the summation of $d_1$, $d_2$, and the thicknesses of the plates 12 and 14. When a blow strikes the brassiere from the front, the distances $d_1$ and $d_2$ are caused to collapse, and part of the energy causing this collapse is absorbed into the brassiere. This also has the same effect as if there were a spring located in the center of the brassiere outward from the sternum. In the configuration shown, the garment will return to the configuration where $d_1$ and $d_2$ are restored after there has been an impact on the brassiere.

Also shown in FIG. 5, is a distance $d_3$ between the inside or inner layer material 28 and the back face of the articulating hard cup plates 12 and 14. This distance $d_3$ is a space between the hard cup plate and the breast which will allow air flow and cooling around the breast as well as a space for the plates 12 and 14 to move into when there is an impact on the outside of the brassiere.

Figure 6:
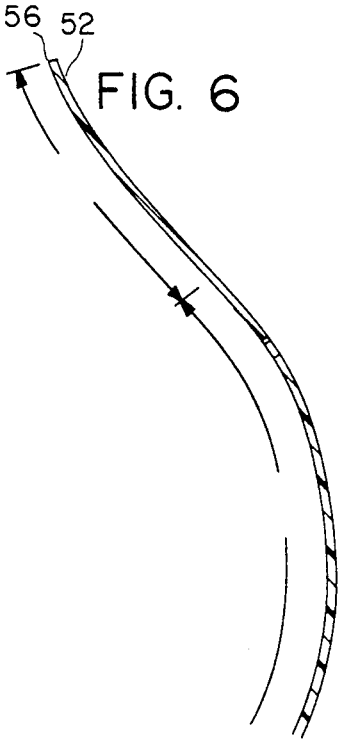
FIG. 6 shows a sectional view of the hard cup plate of FIG. 3 aligned along line 6—6.

In FIG. 6 there is shown a cross-sectional view along lines 6—6 of hard cup breast plate 12 as shown in FIG. 3. The curvature of the top 52 and the bottom 54 are essentially parallel to the users body at the point where the breast plate may contact the body on impact. It should be noted that the hard cup plates 12 and 14 generally remain extended outwardly, spaced by a distance $d_3$ and a distance $d_1$ from the users body when there is no impact on the brassiere.

In this invention, the articulating hard cups 12 and 14, while not connected directly to each other, depend functionally and mechanically on each other to provide the protective function of the brassiere. The hard cups are considered one discreet unit which has two articulating and moving parts 12 and 14.

The two hard cup breast plates 12 and 14 overlap each other at center front as shown in FIGS. 3, 5, 7 and 8. When the wearer assumes a standard anatomical position, the overlap is approximately 1". As can be seen in FIGS. 7 and 8, the vertical edge of the outer of the two cups 12 and 14 rests on top of the inner cup at a relative acute angle. The exact angle will vary according to the specific body contours of the wearer, but is approximately 10 in brassiere sizes 34–36B. The distance from the cups to the sternum (d1) will also vary according to the specific body contours of the wearer; the values will generally be in the range of 1–1.5cm for the outermost cup, and 0.75–1.25cm for the innermost cup.

In this invention, the spring effect is achieved as can be observed from FIG. 5. As a projectile force is applied to the sternum area, it causes the outer cup to slide down the slope displacing the outer cups slightly in the lateral direction, while simultaneously displacing the inner cup laterally (see FIG. 8). The amount of displacement is controlled because the upper tab of the cup is firmly secured in the fabric carrier of the shoulder. This upper tab is seen in FIG. 1 where the upper tab 56 is secured firmly in the fabric carrier portion of the pocket at the shoulder. The later displacement shown in FIG. 8 results in a more gradual deceleration of the projectile for a longer period of time, and causes a portion of the resultant force to be directed laterally instead of towards the body. These two mechanisms combine to significantly decrease the potential for injury in the sternum area.

For an optimal balance between impact protection and thermal comfort, each hard cup 12,14 contains 13 to 15 ventilation holes approximately 3/16" in diameter and distributed across the cup as illustrated in FIG. 3.

In this invention, the cups are molded of a high density plastic material which deforms rather than shatters when maximum impact loads are applied. A specific composite would be a high-density polyethylene which is approximately 1.75mm thick along the external edge of the cup and in the domed center area. The cup may be thinner.

The articulating hard cup plates 12, 14 are centered into the pocket of the brassiere by way of the horizontal opening at the neckline of the fabric carrier, and are held securely in position by plastic snaps 16, 18, 20, 22 and 24. Because the upper tab 56 of each plastic cup 12 and 14 is securely anchored at the shoulder area and because of the natural contour of the wearer's breasts, the cups stay properly positioned and are not able to cause accidental injury by displacing inappropriately. By opening the fasteners 16-24, the cups are removable so that the fabric carrier can be laundered separately.

The front outer layer 46, as shown in FIG. 2A, is constructed of a smooth, thin, high modulus warp knit with minimal extensibility. The front includes a center insert of low modulus low-density synthetic/elastomeric mesh 40 to provide ventilation and to adjust to changes in distance between the breasts during physical activity.

The front layer of FIG. 2A is padded along the lower and auxiliary borders 44 with an open cell foam of approximately ⅛" thickness, backed by a thin, nonabsorbent high wicking jersey fabric. The front inner layer 28, as seen in FIG. 2, is constructed of a light, soft medium modular jersey knit of a fiber with minimum absorption and high-wicking qualities to minimize moisture accumulation at the skin surface. In the best mode, the fabric is constructed of DuPont's type 729W channeled fiber (CoolMax)® blended with Lycra®spandex. This inner layer 28 is smaller than the outer layer 46 to provide support for the breasts within the hard cup and to hold the hard cup plates slightly away from the breasts for better protection and improved ventilation.

The front inner layer 34 (FIG. 2) is a pad in the sternum area at the center front. This pad is an open cell plastic foam of approximately ⅛" thickness and backed by a thin non-absorbent high-wicking jersey fabric. The same pad is used in the shoulder area, 30 and 32. The back unit 50,52, as shown in FIG. 4, are constructed of a light-weight high modulus knitted synthetic/elastomeric blend fabric secured to the front units at the side seam and with broad shoulder straps with low extensibility. The lower rear portion of the shoulder straps 55 is constructed of substantially non-stretchable fabric and adjusts in length with a conventional metal binding 57.

The distances $d_1$ and $d_3$ as, shown in FIG. 5, may vary according to size and figure contour of the wearer, but the overall relationship and provision of spacing at these locations will remain. If the wearer of the brassiere has very little cleavage, then it may be possible for distance d1 to approach 0 in the area of the sternum because the breasts are insufficient to hold the material of the back panel 28 away from the sternum.

The foregoing description of the specific embodiments will so fully reveal the general nature of the invention that others can, by applying current knowledge, readily modify and/or adapt for various applications such specific embodiments without departing from the generic concept, and therefore such adaptations and modifications are intended to be comprehended within the meaning and range of equivalents of the disclosed embodiments. It is to be understood that the phraseology or terminology herein is for the purpose of description and not of limitation.

What is claimed is:

1. A hard cup brassiere comprising:

a fabric portion having a front, shoulder straps, and sides generally conformed to the shape of a female upper torso, and a plurality of layers, wherein said layers form pocket means, and a plurality of overlapping hard cup plates which are placed in said pocket means.

2. The hard cup brassiere of claim 1, wherein said layers form a single pocket which extends across the front of said brassiere.

3. The hard cup brassiere of claim 1, wherein said pocket means extends across the bottom front, up the sides generally in the direction of the wearer's armpits, up from the armpit region to the strap region, and across the strap region to the neckline of said brassiere, said pocket means defining an open top which follows the neckline of said brassiere.

4. The hard cup brassiere of claim 3, further including at least one fastener in said open top of said pocket means.

5. The hard cup brassiere in accordance with claim 4, wherein there is a openable fastener in the bottom front center of said brassiere neckline.

6. The hard cup brassiere in accordance with claim 2, wherein said hard cup plates overlap in the area of a sternum of a wearer of said brassiere.

7. The hard cup brassiere of claim 6, wherein said hard cup plates are spaced outward from the sternum when said brassiere is in its normal position and are pressed against said sternum when there is an impact on the front of said brassiere.

8. The hard cup brassiere in accordance with claim 1, wherein thhe plurality of overlapping hard cup plates are two hard cup plates which overlap in the region of a sternum of a wearer of said brassiere.

9. The hard cup brassiere in accordance with claim 1, wherein the wearer's right hand hard cup plate lies outward from the left hand hard cup plate when the wearer is righthanded.

10. The hard cup brassiere of claim 1, wherein the wearer's left hand plate lies outward from the right hand plate when said wearer is left-handed.

11. The hard cup brassiere in accordance with claim 1, wherein said plurality of overlapping hard cup plates are two hard cup plates which overlap in thhe region of a sternum of a wearer of said brassiere, and are normally spaced outward from the sternum.

12. The hard cup brassiere in accordance with claim 1, wherein the peripheries of said hard cup plates form extensions which spread the force of an impact blow over an extension area formed by the extensions.

13. The hard cup brassiere in accordance with claim 12, wherein said extension area is spaced outwardly from a sternum of a wearer of said brassiere when normally worn, and which contacts the sternum when said brassiere is impacted from the front.

14. The hard cup brassiere in accordance with claim 1, wherein said overlapping portions of said hard cup plates in combination with fabric of said brassiere provide a spring action whereby said hard cup plates and said fabric can easily move forward from a sternum of a wearer of said brassiere when said brassiere returns to its normal position after having been forced against the sternum.

15. The hard cup brassiere in accordance with claim 14, wherein said hard cup plates move laterally outward from the sternum when they are pressed inwards toward the sternum.

16. The hard cup brassiere in accordance with claim 1, wherein said hard cup plates each have an "S" shape cross section when taken along a horizontal line across the center.

17. The hard cup brassiere in accordance with claim 1, wherein said pocket means is formed with an expansion space located between an inner layer and an outer layer of said brassiere in a sternum area of the wearer of said brassiere.

18. The hard cup brassiere of claim 1, wherein said brassiere has an inner layer of brassiere fabric and an outer layer of brassiere fabric, the inner layer as measured at the horizontal center line is less than the distance across the outer layer.

19. The hard cup brassiere of claim 1, wherein said hard cup plates normally press against a wear of said brassiere only at a region of said hard cup plates which lies at the armpit region of said brassiere.

20. The hard cup brassiere of claim 1, wherein said hard cup plates are maintained at a spaced distance to a sternum of the wearer of said brassiere.

21. The hard cup brassiere of claim 1, wherein said hard cup plates are held outwardly from a sternum of a wearer of said brassiere by a coaction of an inner layer and an outer layer of a fabric.

22. The hard cup brassiere of claim 21, wherein there is a space (d3) between said inner layer and a surface of said hard cup plates adjacent the wearer at a horizontal center line of each breast.

23. A hard cup brassiere of claim 1, wherein said hard cup plates move laterally outward from an inward towards a sternum of a wearer of said brassiere when said brassiere receives an impact at a center line of the sternum and on top of the overlapping region of said hard cup plates.

24. The hard cup brassiere of claim 1, wherein said hard cups are first and second hard cups each having a different shape and wherein said first and second hard cups overlap, with thhe first hard cup extending further towards the second hard cup than the second hard cup extends toward the first hard cup.

25. The hard cup brassiere of claim 24, wherein said hard cup which extends further also lies closest to a sternum of a wearer of said brassiere.

26. The hard cup brassiere of claim 24, wherein said one hard cup plate extends approximately ½" further than the other hard cup plate.

* * * * *